United States Patent [19]

Ferguson et al.

[11] Patent Number: 4,872,239

[45] Date of Patent: Oct. 10, 1989

[54] DOOR CLOSURE WITH MECHANICAL BRAKING MEANS

[75] Inventors: Edward H. Ferguson, Arlington Heights; Kiyoshi Iha, Elk Grove Village, both of Ill.

[73] Assignee: The Chamberlain Group, Inc., Elmhurst, Ill.

[21] Appl. No.: 230,433

[22] Filed: Aug. 10, 1988

[51] Int. Cl.[4] ..... E05F 1/10; E05F 5/02

[52] U.S. Cl. ..... 16/64; 16/79; 16/85; 16/DIG. 10

[58] Field of Search ..... 16/49, 51, 62, 64, 69, 16/71, 85, DIG. 9, DIG.10, 79

[56] References Cited

U.S. PATENT DOCUMENTS

| | | | |
|---|---|---|---|
| 1,126,635 | 1/1915 | Henry | 16/69 |
| 2,045,076 | 6/1936 | Garrison | 16/69 X |
| 2,650,386 | 9/1953 | Edwards | 16/49 |

FOREIGN PATENT DOCUMENTS

| | | | |
|---|---|---|---|
| 85847 | 9/1921 | Fed. Rep. of Germany | 16/69 |

*Primary Examiner*—Nicholas P. Godici
*Assistant Examiner*—William Scott Andes
*Attorney, Agent, or Firm*—Hill Van Santen, Steadman & Simpson

[57] ABSTRACT

A mechanical disk-type door closure wherein one end of the closure is connected to a door and the other end is pivotally connected to a door jam such that when the door pivots about its hinge. The closure includes a rod upon which a rack is formed to cause a pinion to rotate in one direction and which is in mesh with a gear so as to move the pinion out of contact with the rack. When the door closes, a spring moves the pinion into engagement with the rack and the pinion turns in a direction to rotate the gear which is subjected braking pressure so as to adjust the resistance to the closing motion of the door.

6 Claims, 2 Drawing Sheets

DOOR CLOSURE WITH MECHANICAL BRAKING MEANS

BACKGROUND OF THE INVENTION

1. Field of the Invention

This invention relates in general to a mechanical disk-type door closure and in particular to an improved door closure mechanism.

2. Description of the Related Art

Door closures are known which include a cylinder and piston with a fluid such as air or oil and wherein during door opening or closing, the piston compresses the fluid so as to prevent a door from slamming. Such door closures are difficult to adjust in that the leakage of the fluid must be adjusted so as to control the speed of operation of the door closing mechanism.

SUMMARY OF THE INVENTION

It is an object of the present invention to provide a mechanical disk-type door closure which has closer assembly with one end attached to a door and the other end pivotally attached to a door jam. When the door is opened, the closer housing moves about its pivot and causes a spring to compress and a pinion engages a rack formed on a rod so as to move the pinion in a first direction. The pinion also engages a gear and then in the opening direction, the pinion rides up on the gear out of engagement with the rack since the pinion is loosely mounted in its support. Upon closing, a spring moves the pinion into engagement with the rack and the rack turns the pinion which turns the gear. Brake means including disk pads are adjustable so as to vary the braking force applied to the gear and, thus, to control speed of the door closing motion.

It is an object of the present invention to provide an improved fluid-free door closing mechanism.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
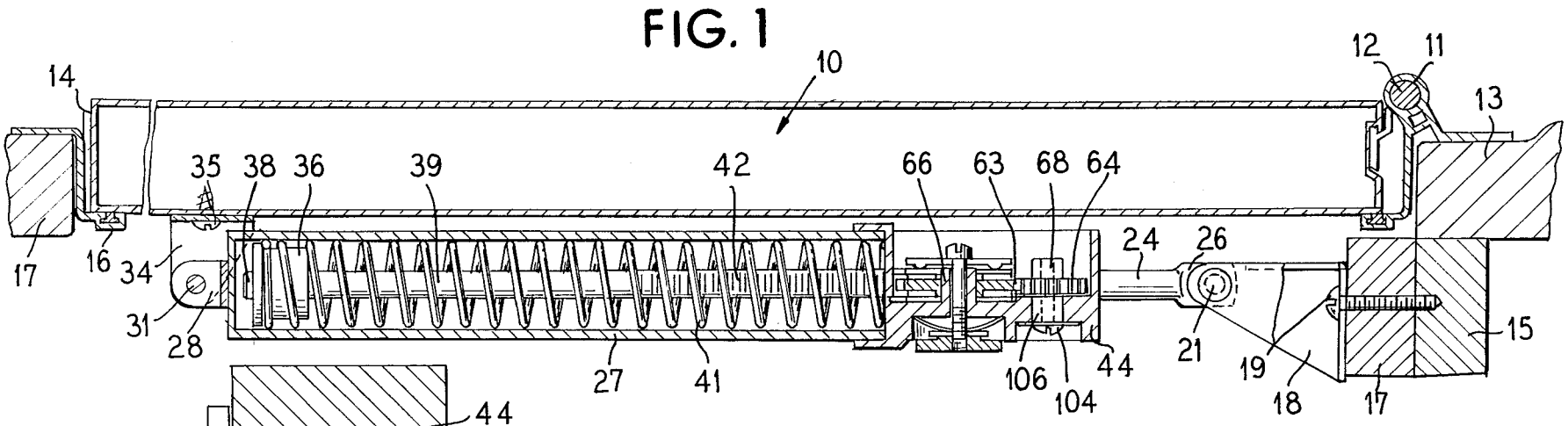
FIG. 1 is a partial cut-away view of the door closure of the invention.
Figure 3:
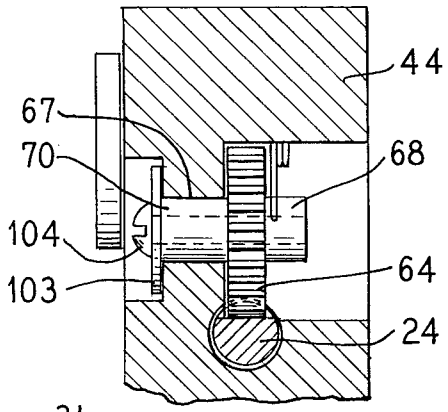
FIG. 3 is a sectional view of the door closure housing.
Figure 2:
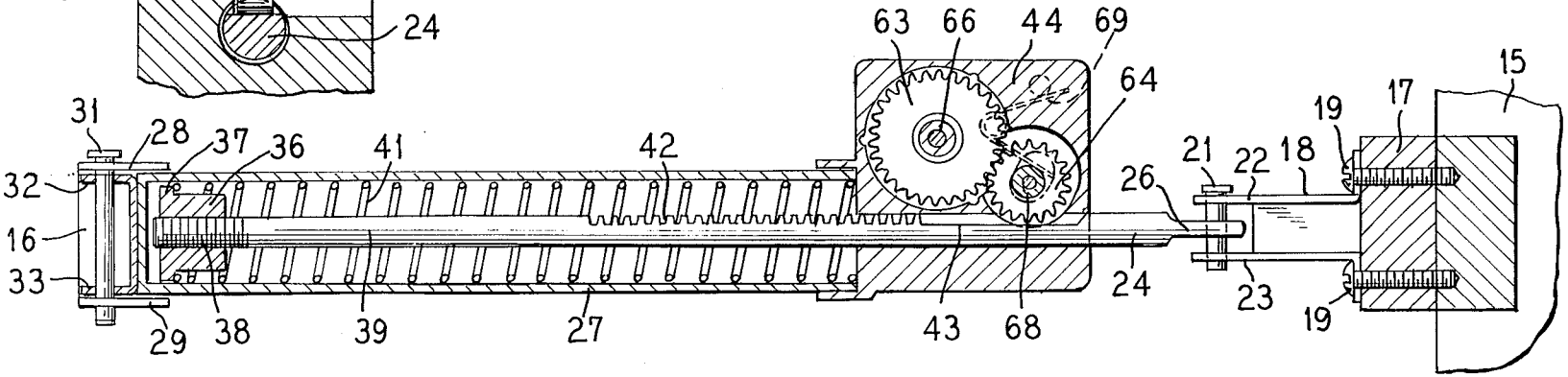
FIG. 2 is a partially section view of the door closure of the invention at right angles to the view of FIG. 1.
Figure 4:
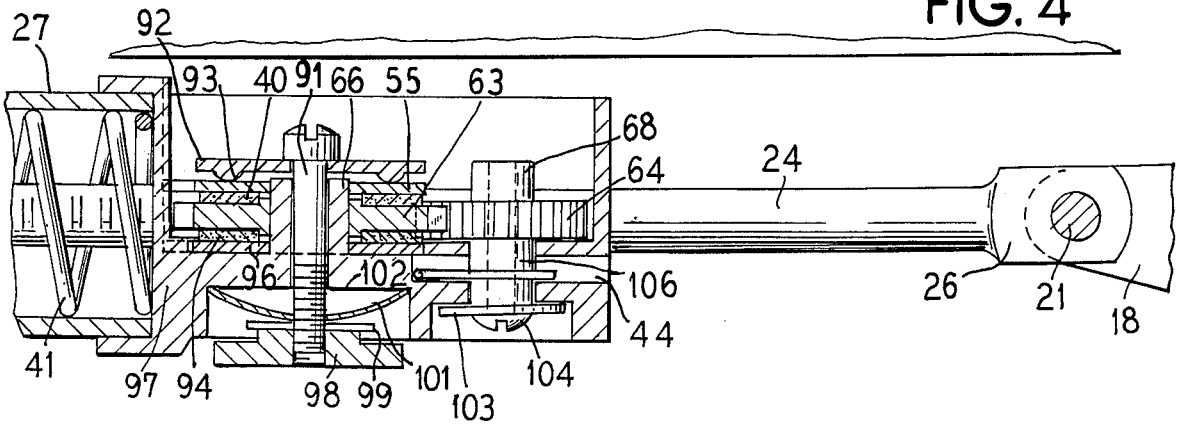
FIG. 4 is a sectional view of the door closure mechanism.

FIG. 1 illustrates a door 10 which is pivotally supported by a hinge 11 that has a pivot pin 12 from a jam 13. The other end of the door 14 when in the closed position engages a stop 16 which is mounted on a jam 17. Jam members 15 and 17 adjacent the jam 13 support a bracket 18 which is connected by screws 19 to the jams 17 and 15. A rod 24 has one end 26 pivotally connected to planar members 22 and 23 of the bracket 18 with a pin 21 as shown in FIG. 2. The rod 24 extends through a housing 44 and into a cylindrical portion 27 connected to the housing 44. The other end of the portion 27 has a U-shaped pivot member 16 which is pivotally connected to arms 28 and 29 of a bracket 34 which is connected by screws 35 to the surface of the door 10 as shown in FIG. 1.

Figure 5:
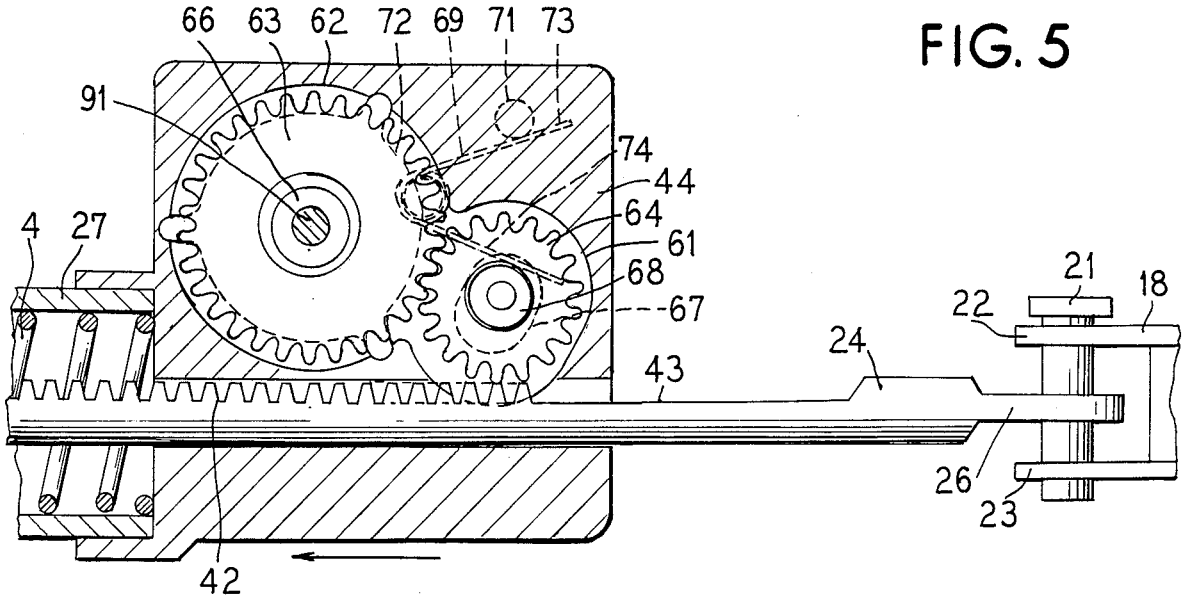
FIG. 5 is a partially cut-away sectional view of the door closure mechanism when the door is opening.
Figure 6:
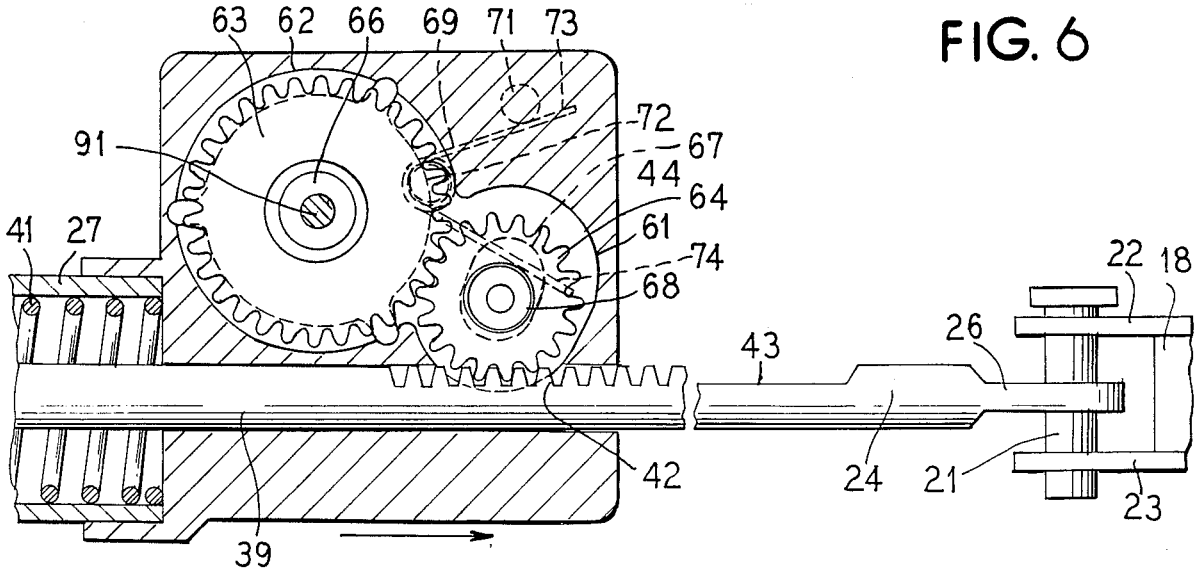
FIG. 6 is a partially cut-away sectional view of the door closure mechanism when the door is closing.

Mounted within the cylindrical member 27 is a threaded member 36 which is received on threads 38 of the end 39 of the rod 24 and the member 36 is formed with a shoulder 37 which engages a spring 41 which surrounds the rod portion 39 and its other end engages the housing 44. The rod 24 is formed with a rack portion 42 intermediate its ends and a slot 43 is formed adjacent the rack portion 42 between the rack and the end 26 as shown in FIGS. 2, 5, and 6. As best shown in FIGS. 1, 2, 3 and 4, a pinion gear 64 is formed with extending shaft portions 68 and 70 on either side thereof and portion 70 rides in a slot 67 which allows transverse motion of the gear 64 relative to the rod 24. A washer 103 is held by a screw 104 to the portion 70 and a spring 69 has a first end 73 which engages a pin 71 mounted in the housing 44 and passes around a pin 72 mounted in the housing 44 and engages the pinion 68 so as to bias pinion gear 64 into engagement with the rack 42.

A gear 63 is mounted in the housing 44 so that its teeth engage the pinion gear 64. The gear 63 is rotatably mounted on an extension 66 of the housing 44. A disc 92 is held by bolt 91 and a projection 93. A disk plate 55 is engaged by the projection 93 and bears on a disk pad 40 which engages one surface of the gear 63. A second disk pad 94 engages the other side of the gear 63 and a disk plate 96 is mounted between the pad 94 and the housing 44. A pressure spring 101 has ends which engages a surface 102 of the housing 44 and the bolt 91 extends therethrough and passes through a washer 99 and an adjusting knob 98 is threadedly received on the threaded end of the bolt 91 so as to adjust the brake pressure on the side surfaces of the gear 63.

In operation, assuming that the door is closed and in the position shown in FIGS. 1 and 2, the pinion gear 64 will be positioned with its teeth in the slot 43 of the rod 24. As the door is opened, the housing 44 and the cylindrical portion 27 will move to the left relative to the FIGS. and when the pinion gear 64 engages the rack 42, the rack will tend to rotate the pinion gear counterclockwise relative to FIGS. 2, 5 and 6. When this occurs, the pinion gear 64 will ride up on the teeth of the gear 63 out of engagement with the rack 42 as shown in FIG. 5 with the pinion portions 68 and 70 moving in the slot 67 against the tension of the spring 69. The door will continue opening with shaft 24 and housing 44 moving to the left relative to FIGS. 1, 2, 4, 5 and 6 until the limit of the door opening has occurred.

When the door is released for closing, the pinion gear 64 will be biased by the spring 69 so that the pinion portions 68 and 69 move in slot 67 such that the teeth of the pinion gear 64 engage the rack 42 which causes the gear 64 to rotate in a clockwise direction relative to FIGS. 2, 5 and 6. Fr the gear 64 to rotate in the clockwise direction, it is necessary that gear 63 rotate in the counterclockwise direction since the teeth of gears 64 and 63 are in mesh. Since the gear 63 is subjected to the brake mechanism comprising the pressure pads 40 and 94, the gear 63 will rotate during closing, but it will restrict the speed of closing of the door and thus limit the speed of rotation of the pinion gear 64 in the rack 42. This prevents the door from slamming shut. When the door is substantially closed and is swung to a position of approximately 30° from closing, the pinion gear 64 leaves the end of the rack 42 and moves in the slot 43 of the rod 24 and the door completely closes due to the action of the spring 41 which pulls the door to its fully closed position.

The speed of closing can be adjusted by adjusting the knob 98 which applies through the spring 101 adjustable brake pressure to the gear 63. Thus, if a door closes too fast, the knob 98 can be rotated to apply greater pressure on the brake pads 90 and 94. Alternatively, if the door closes too slowly, the knob 98 can be rotated in the opposite direction to reduce the braking force on the pads 90 and 94.

It is seen that this invention provides a novel door closure mechanism and although it has been described with respect to preferred embodiments, it is not to be so limited as changes and modifications may be made therein which are within the full intended scope as defined by the appended claims.

We claim as our invention:

1. A door closure mechanism for a pivoted door which pivots about a pivot point comprising, a longitudinal rack member with one end pivotally attached to a door jam adjacent the said pivot point of said door and formed with a rack, a housing into which said rack member extends, said housing pivotally attached to said door at a point remote from said pivot point of said door, first spring means mounted in said housing and urging said rack member into said housing to bias said door toward the closed position, a pinion gear rotatably mounted in said housing and engageable with said rack, brake means coupled to said pinion gear, wherein said brake means includes a second gear rotatably supported by said housing and in mesh with said pinion gear, and wherein said pinion gear is loosely mounted in said housing for movement into and out of engagement with said rack and a second spring which engages said pinion gear so as to bias it into engagement with said rack.

2. A door closure for a pivoted door according to claim 1 wherein said brake means comprises a pressure pad means which engages said second gear.

3. A door closure for a pivoted door according to claim 2 wherein said brake means includes a bolt and a threaded knob mounted in said housing and engageable with said pressure pad means so as to allow the braking force on said second gear to be adjusted.

4. A door closure for a pivoted door according to claim 3 including a pressure spring adjustable by said threaded knob to vary the braking force on said second gear.

5. A door closure for a pivoted door according to claim 1 wherein during opening motion of said door said pinion gear is moved out of engagement with said rack by said second gear as said second gear rotates in a first direction due to being loosely mounted in said housing and during closing motion of said door, said pinion gear moves into engagement with said rack and is held in such engagement by said gear as said second gear rotates in a second direction.

6. A door closure for a pivoted door according to claim 5 wherein said rack member has a slot at one end of said rack into which said pinion gear is received as said door approaches the closed position.

* * * * *